US006264550B1

(12) United States Patent
Matsumoto

(10) Patent No.: US 6,264,550 B1
(45) Date of Patent: Jul. 24, 2001

(54) CLEAN ROOM AND METHOD OF REMODELING CLEAN ROOM

(75) Inventor: Yoshihiro Matsumoto, Tateyama (JP)

(73) Assignee: Nippon Steel Semiconductor Corporation, Chiba (JP)

( * ) Notice: Subject to any disclaimer, the term of this patent is extended or adjusted under 35 U.S.C. 154(b) by 0 days.

(21) Appl. No.: 09/559,410

(22) Filed: Apr. 26, 2000

Related U.S. Application Data

(62) Division of application No. 09/114,152, filed on Jul. 13, 1998, now abandoned.

(30) Foreign Application Priority Data

Jul. 11, 1997 (JP) ..... 9-186566

(51) Int. Cl.[7] ..... B01L 1/04
(52) U.S. Cl. ..... 454/187
(58) Field of Search ..... 454/187, 298, 454/333, 284, 292, 296, 334; 55/385.2

(56) References Cited

U.S. PATENT DOCUMENTS

| | | | | |
|---|---|---|---|---|
| 4,549,472 | * | 10/1985 | Endo et al. | 454/187 |
| 4,667,579 | * | 5/1987 | Daw | 454/187 |
| 4,693,175 | * | 9/1987 | Hashimoto | 454/187 |
| 4,850,268 | * | 7/1989 | Saito et al. | 454/187 |
| 4,950,423 | * | 8/1990 | Sullivan | 252/512 |
| 5,096,477 | * | 3/1992 | Shinoda et al. | 55/385.2 |
| 5,792,226 | * | 8/1998 | Lee et al. | 55/385.5 |
| 5,828,572 | * | 10/1998 | Hasegawa et al. | 364/468.24 |

FOREIGN PATENT DOCUMENTS

| | | | | |
|---|---|---|---|---|
| 129123 | * | 8/1983 | (JP) | 454/187 |
| 62-5031 | | 1/1987 | (JP) . | |
| 147249 | * | 7/1987 | (JP) | 454/187 |
| 103328 | * | 4/1990 | (JP) | 454/187 |
| 3-177732 | | 8/1991 | (JP) . | |
| 5-149591 | | 6/1993 | (JP) . | |
| 405223303 | * | 8/1993 | (JP) | 454/187 |

* cited by examiner

*Primary Examiner*—Denise L. Ferensic
*Assistant Examiner*—Derek S. Boles
(74) *Attorney, Agent, or Firm*—Crowell & Moring, L.L.P.

(57) ABSTRACT

The present invention is to provide a method of remodeling an existing clean room building into a clean room which satisfies a new required specification. A working room (11) is expanded by removing a wall (29) between the working room (11) and a general passage (30). If a portion of the floor of the working room (11) is not the grated panel structure, such floor portion is formed as the grated panel structure by remodeling and the floor is formed as a perforated free access floor. The whole of the ceiling of the working room (11) is formed as a system ceiling of a frame structure from which a dust-collecting filter whose unit size is 600×1200 mm can be made freely detachable if necessary, and a ULPA filter is disposed on a portion which is requested to have a high cleanliness. An air-insulating panel of the same size may be attached to a portion which does not require the dust-collecting filter. An existing air conditioner that has been in use before remodeling is used as the air conditioner as it is.

7 Claims, 8 Drawing Sheets

CLEAN ROOM AND METHOD OF REMODELING CLEAN ROOM

This application is a division of application Ser. No. 09/114,152, filed Jul. 13, 1998, abandoned.

BACKGROUND OF THE INVENTION

1. Field of the Invention

The present invention relates to a clean room used to fabricate semiconductor devices and a clean room remodeling method used to remodel an existing clean room to provide a clean room with a different specification if necessary, and to remodel a general passage or room adjacent to a clean room to provide a clean room.

2. Description of the Prior Art

Semiconductor devices are extremely sensitive to dusts such as dust particles in their fabrication process. Hence, it is customary that semiconductor devices are variously processed on the fabrication line in a clean room. A clean room generally comprises a working room used to fabricate semiconductor devices in actual practice, a supply chamber built in a space above the ceiling of the working room to supply the air to the working room, a dust-collecting filter for removing dust particles from the air supplied to the working room, a grated panel built on the floor of the working room to let in the air, a return chamber for returning the air from the grated panel through a circulation duct and an air conditioner for circulating the air in the sequential order of the supply chamber, the working room and the return chamber and which is also used to adjust the temperature and the humidity of the air.

A cleanliness of clean room changes depending upon factors such as an integration degree of semiconductor devices manufactured therein. A variety of dust-collecting filters are used in response to a required cleanliness. As a dust-collecting filter, there are selectively employed a HEPA (High Efficiency Particulate Air) filter and a ULPA (Ultra Low Penetration Air) filter, etc. Japanese laid-open patent publication No. 5-149591 and Japanese laid-open patent publication No. 3-177732, for example, described such clean room.

So far a new clean room is required, it is customary that a new clean room is built in a vacant lot, including a foundation work. The reason for this will be described. As the semiconductor technologies are advanced rapidly, requirements concerning the specifications of the new clean room become severer than those of the prior art. Hence, it was rather easy to build a new clean room including the setting of blow capacities of air conditioners and a layout of places in which dust-collecting filters are located.

However, recently, a difficulty in maintaining a labor power and obtaining a building lot increases, and a cost of building a clean room occupies a large ratio of the entire cost. Therefore, it is expected that it becomes more and more difficult to build a semiconductor factory including a clean room.

SUMMARY OF THE INVENTION

In view of the aforesaid aspect, it is an object of the present invention to provide a method of remodeling an existing clean room building into a clean room which may satisfy a new required specification.

In order to attain the above-described object, according to the present invention, there is provided a clean room remodeling method for remodeling a clean room including an air conditioner and a return chamber located on a first floor, a semiconductor fabrication working room located on a second floor above the first floor and a supply chamber located in a space above the ceiling of the working room to supply the air to the working room. This method is comprised of the steps of forming a floor of the working room as a grated panel structure, forming a ceiling of the working room as a system ceiling, disposing a first dust-collecting filter in a ceiling of the working room at its area in which a high cleanliness is required partly, disposing a second dust-collecting filter or an air-shielding member in ceilings of other areas and using the air conditioner as it is.

According to the present invention, the first dust-collecting filter is a ULPA filter and the second dust-collecting filter is a HEPA filter.

According to the present invention, there is provided a clean room remodeling method in which a clean room is expanded by removing a wall which partitions a clean room and a room adjacent to the clean room. This clean room remodeling method is comprised of a process for setting a first detachable partition panel near the wall within the clean room, a process for removing the wall, a process for setting a second detachable partition panel at a place from which the wall was removed, a process for removing the first partition panel, a process for cleaning air in the room and a process for joining the clean room and the room by removing the second partition panel after the process of cleaning the air in the room is completed.

According to the present invention, the room is a clean room.

According to the present invention, there is provided a clean room remodeling method which is comprised of a process for expanding a clean room area by removing a whole-process direction wall between an existing clean room and a general room, a process for installing an interbay transportation apparatus in an upper portion of an area which was the general room, a process for extending a process line provided in the direction substantially perpendicular to the whole-process direction, and a process for partitioning an area which was a clean room and an area in which the interbay transportation apparatus is installed.

According to the present invention, there is provided a clean room remodeling method which is comprised of a process for dividing an existing clean room having a plurality of air conditioners into a plurality of areas corresponding to the unit of the air conditioner by a partition panel, a process for constructing each of divided areas sequentially in order to increase a cleanliness, a process for cleaning the air of every area whose construction is ended, and a process for removing a partition panel when the adjacent area reaches the same predetermined cleanliness.

According to the present invention, there is provided a method of remodeling a general room into a clean room which is comprised of the steps of, with respect to an existing building having a first floor, a second floor, and a space above a ceiling of the second floor, providing an air conditioner and a return chamber on the first floor, forming a floor of the second floor as a grated panel structure, disposing a dust-collecting filter in the ceiling of the second floor, providing a supply chamber in the space above the ceiling of the second floor, joining the return chamber and the supply chamber by a duct, and forming the second floor as a semiconductor fabrication working room.

According to the present invention, in a clean room including an air conditioner and a return chamber provided on a first floor, a semiconductor fabrication working room provided on a second floor above the first floor and a supply chamber located in the space above the ceiling of the working room to supply the air to the working room, the clean room is characterized in that an area having a high cleanliness specification within the working room is isolated by a partitioning member from other areas, a first dust-collecting filter having a high cleanliness specification on the ceiling of a working room space surrounded by the partitioning member and a floor of the working room space is formed as a grated panel structure.

According to the present invention, the partitioning member comprises an acrylic board processed by an electrostatic preventing treatment.

Further, according to the present invention, the working room comprises a working room space surrounded by the partitioning member and a surrounding working room which have a difference of cleanliness level greater than 100 times therebetween.

Furthermore, a ceiling of an area other than the area having a high cleanliness specification of the working room includes an air-insulating member or a second dust-collecting filter whose cleanliness is lower than that of the first dust-collecting filter.

DESCRIPTION OF THE PREFERRED EMBODIMENT

Figure 1:
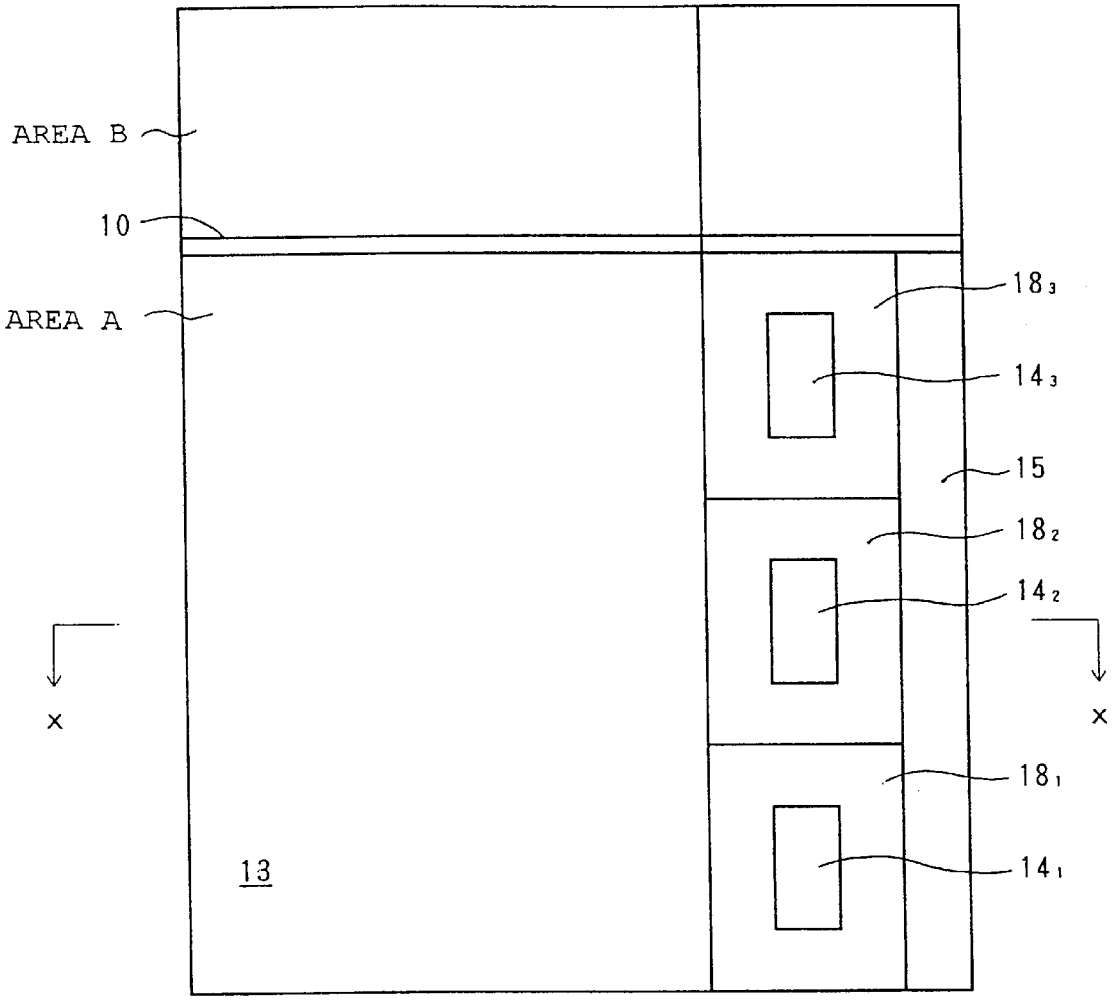
FIG. 1 is a plan view of a first floor of a clean room before remodeling.
Figure 2:
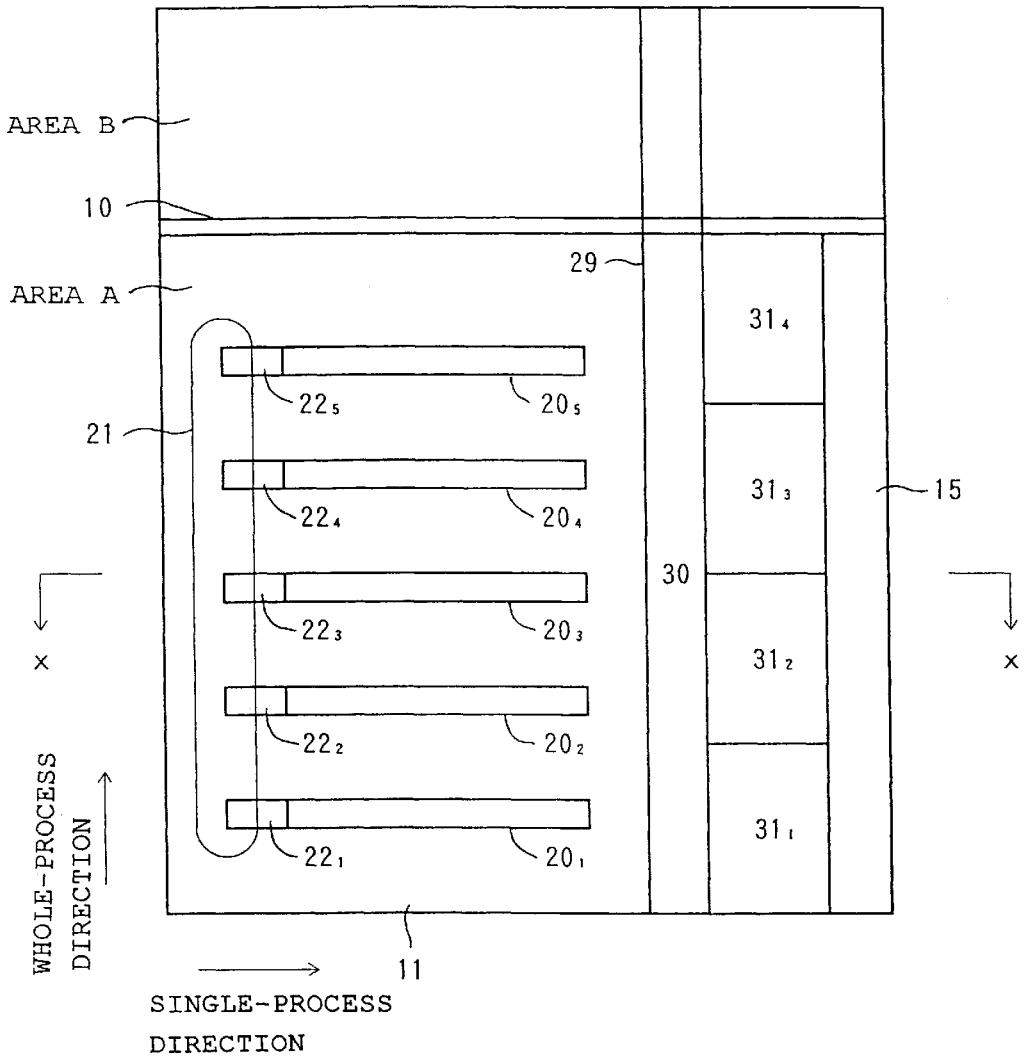
FIG. 2 is a plan view of a second floor of the clean room before remodeling.
Figure 3:
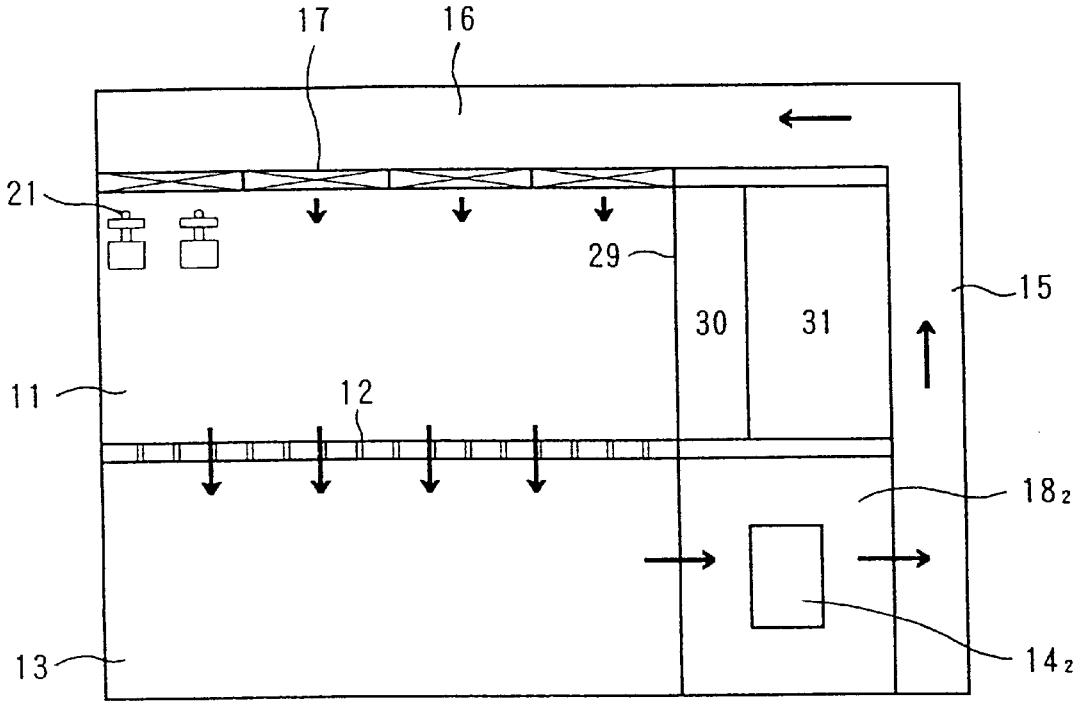
FIG. 3 is a cross-sectional view taken along the line x—x in FIGS. 1 and 2.
Figure 4:
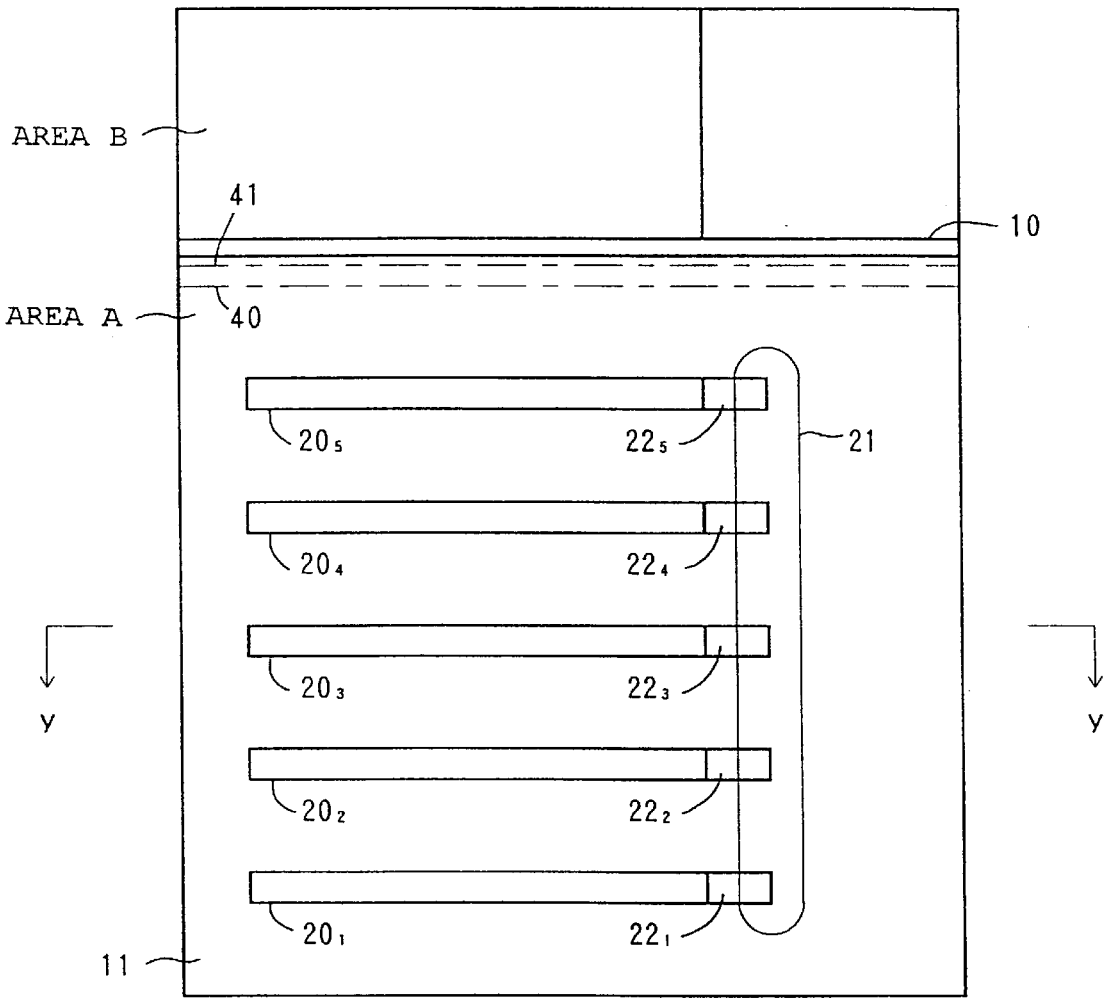
FIG. 4 is a plan view illustrating the state in which a wall between a working room of the second floor of the clean room and a general passage is removed and the working room is expanded to the area that was the general passage before.
Figure 5:
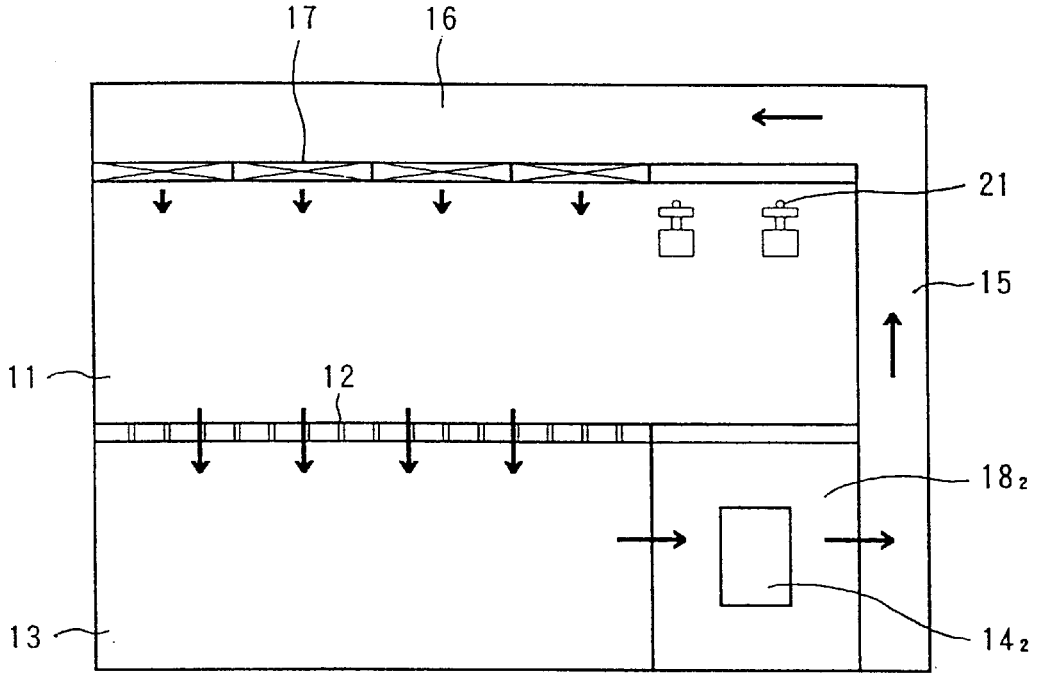
FIG. 5 is a cross-sectional view taken along the line y—y in FIG. 4.
Figure 6:
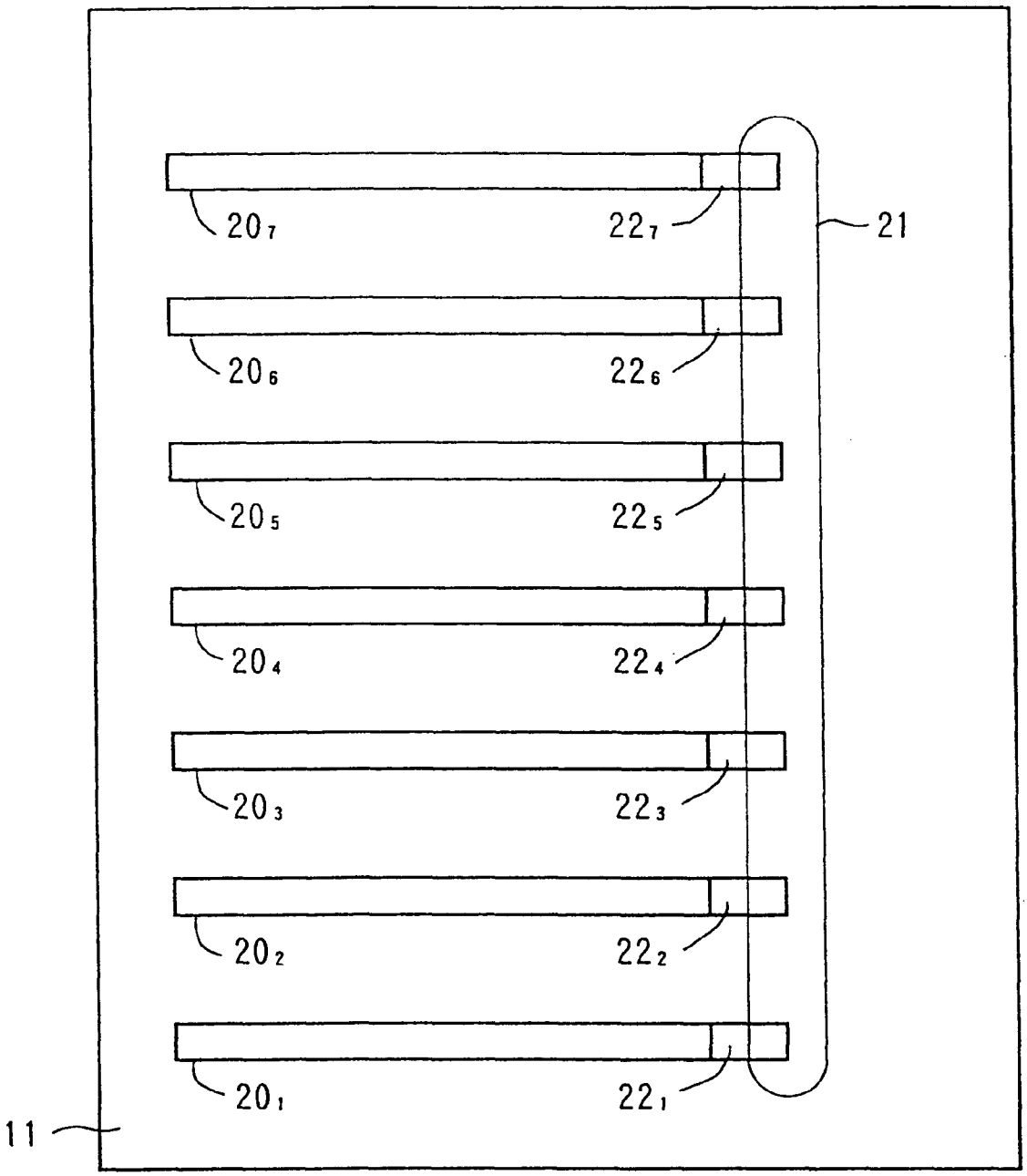
FIG. 6 is a plan view illustrating the state in which a wall between A and B areas is removed to enable the entirety to become one working room.
Figure 7:
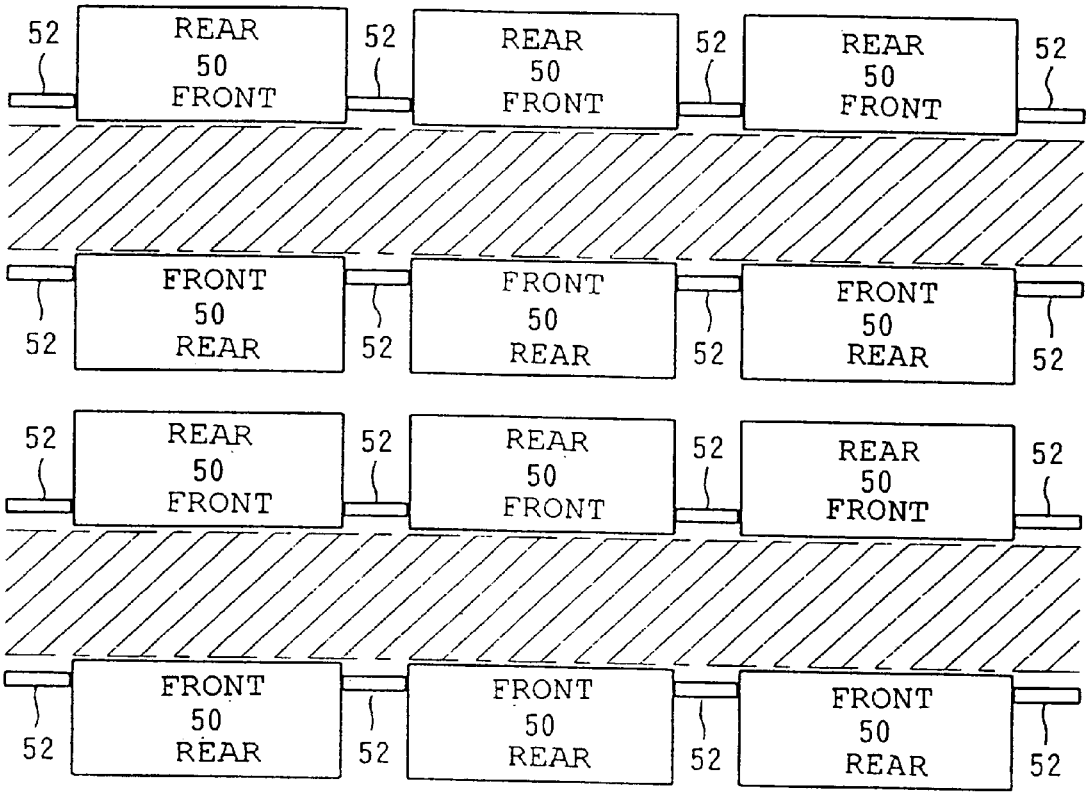
FIG. 7 is a plan view showing the layout of various treatment equipment in the remodeled working room.

The preferred embodiments of the present invention will hereinafter be described with reference to the drawings. FIG. 1 is a plan view of a first floor of a clean room before remodeling; FIG. 2 is a plan view of a second floor of the clean room before remodeling; FIG. 3 is a cross-sectional view taken along the line x—x in FIGS. 1 and 2; FIG. 4 is a plan view illustrating the state in which a wall between the working room of a second floor of the clean room and a general passage is removed to expand the working room to the area which was the general passage before; FIG. 5 is a cross-sectional view taken along the line y—y in FIG. 4; FIG. 6 is a plan view illustrating the state in which a wall between areas A and B is removed to enable the entirety to become one working room; and FIG. 7 is a plan view illustrating the layout of various treatment equipment in the remodeled working room.

Before remodeling, in the clean room according to this embodiment, as shown in FIGS. 1 and 2, areas A and B were partitioned by a wall 10. A working room of the area A was a clean room whose cleanliness is relatively high (about cleanliness class 100), and a working room of the area B was a clean room whose cleanliness was relatively low (about cleanliness class 10000). Both of the areas A and B comprise a first floor, a second floor and a space above a ceiling of the second floor, each of which is partitioned by the common wall 10 to provide the areas A and B.

After the existing clean room shown in FIGS. 1 and 2 is remodeled by a clean room remodeling method according to this embodiment, the area A is expanded to the areas of a general passage, a general room and other portions than the clean room (these room portions will be generally referred to as "general room" in this specification), and a cleanliness thereof is increased to a class 1 (or higher than cleanliness class 1). Further, a continuous space in which the wall 10 for partitioning the areas A and B is removed is served as a single clean room, and the area which was used as the area B is given the same high cleanliness as that of the area A.

As shown in FIGS. 1 to 3, in the clean room according to this embodiment, the first floor includes a return chamber 13 and air-conditioning rooms $\mathbf{18}_1$ to $\mathbf{18}_3$ (when the air-conditioning room is generally referred to, it is denoted by reference numeral 18 without suffixes and this applies for other elements and parts as well). The air-conditioning rooms $\mathbf{18}_1$ to $\mathbf{18}_3$ include air conditioners $\mathbf{14}_1$ to $\mathbf{14}_3$. The second floor includes a working room 11 in which a manufacturing line of semiconductor devices is installed in actual practice, and a supply chamber 16 is located in a space above the ceiling of the second floor. Before remodeling, the floor of the area A was partly formed by a grated panel 12 as a free access floor in which an area corresponding to an area in which a dust-collecting filter 17, which will be described later on, is located in the ceiling. Specifically, air supplied from the supply chamber 16 through the dust-collecting filter 17 to the working room 11 flows downwardly in the working room 11 of the second floor and flows through the grated panel 12 to the return chamber 13 of the first floor. The air in the return chamber 13 is adjusted in temperature and humidity by the air conditioner 14, blown by fans of the air conditioner 14 to the upper direction through a duct room 15 and reaches the supply chamber 16 in a space above the ceiling of the working room. Incidentally, the air conditioners $\mathbf{14}_1$ to $\mathbf{14}_3$ are treated by a vibration-isolation insulating treatment in order to prevent their vibrations from being transmitted to the clean room.

The air supplied to the supply chamber 16 flows through the dust-collecting filter 17 located in the ceiling of the working room 11 into the working room 11. At that time, dust particles are removed from the air by the dust-collecting filter 17. Thus, the flow of clean air partly flowing downwardly occurs within the working room 11, and the area for treating semiconductor devices is held at a predetermined cleanliness. In this embodiment, before remodeling, the dust-collecting filter 17 is located on the ceiling of the area in which wafer treatment equipment is located, and the dust-collecting filter 17 is located only a portion of the ceiling of other areas. Before remodeling, a HEPA filter, for example, is used as the dust-collecting filter 17. With respect to the area under the HEPA filter and in which the wafer treatment equipment is located, a cleanliness of about class 100 was realized.

As shown in FIG. 2, in the working room 11 of the second floor, one line (e.g. line of photolithography process, etc.) is located in the right and left direction (single process direction) of the sheet of drawing. Accordingly, when wafers are located on any of the lines, wafers are moved along the single process direction. In the whole-process direction extended in the upper and lower direction of FIG. 2, a plurality of lines $\mathbf{20}_1$, $\mathbf{20}_2$, $\mathbf{20}_3$, $\mathbf{20}_4$, $\mathbf{20}_5$ are located in parallel to each other. The length of the whole-process direction is about 100 m. Having treated by a predetermined treatment at every line, wafers are conveyed to the next line. This convey work was executed by an interbay transportation machine 21 located at the left-hand side ceiling of the working room 11 (see FIGS. 2 and 3). Therefore, the exchange of wafers between each line and the interbay transportation machine 21 is executed at stations $\mathbf{22}_1$ to $\mathbf{22}_5$ located on the left-hand side end of each line.

Also, as shown in FIGS. 2 and 3, a general passage 30 is adjacent to the right-hand side of the existing working room 11 through a wall 29 extending in the whole-process direction. General rooms 31 ($\mathbf{31}_1$ to $\mathbf{31}_4$) are located adjacent to the right-hand side of the passage 30. Operators dressed with ordinary clothes may pass or enter the general passage 30 and the general rooms 31.

In this embodiment, the existing clean room shown in FIGS. 1 to 3 is remodeled to provide a clean room shown in FIGS. 4 to 6 by a predetermined construction, whereby a higher cleanliness is achieved. The second floor portion of the area B adjacent to the area A is remodeled into a working room having substantially the same cleanliness as that of the working room in the area A. To this end, the construction is made by the following procedure.

Initially, as shown in FIG. 4, a wall between the working room 11 and the general passage 30 of the second floor and a wall between the general passage 30 and the general room 31 are removed to thereby expand the working room 11 up to the area which had been so far the general passage 30 and the general room 31. Concurrently therewith, the interbay transportation machine 21 that was located at the upper left end of the working room 11 as shown in FIGS. 1 and 3 is installed at the upper portion of the area which had been the general passage 30 and the general rooms $\mathbf{31}_1$ to $\mathbf{31}_4$. Also, on the right-hand end of each line (lower portion of the interbay transportation machine 21), there are provided stations $\mathbf{22}_1$ to $\mathbf{22}_5$ used to interchange wafers between the line and the interbay transportation machine 21. As a consequence, as shown in FIG. 4, the length of each of the lines $\mathbf{20}_1$, $\mathbf{20}_2$, $\mathbf{20}_3$, $\mathbf{20}_4$, $\mathbf{20}_5$ may be increased in the single-process direction longer than those of the past lines (see FIG. 2).

In this case, according to this embodiment, since the dust-collecting filter was not located in the area which had been so far the general passage 30 and the general room 31, the area (existing general passage 30 and the general rooms $\mathbf{31}_1$ to $\mathbf{31}_4$) in which the interbay transportation machine 21 is newly located and the working room which is not remodeled are isolated from each other by a partition panel (not shown). In the area which had been the general passage 30 and the general room 31 so far, wafers are transported by the interbay transportation machine 21 under airtight state so that a cleanliness of this area may be about class 1000. Wafers are interchanged through the partition panel by the stations. However, when the dust-collecting filter may be located on the ceiling of the portion in which the interbay transportation machine 21 is newly located, the above-mentioned partition panel need not always be used.

Next, of the floor of the working room 11, when there is a portion which is not of the grated panel structure, a floor of a portion which is requested to become high in cleanliness is formed as a perforated free access floor by the grated panel structure. Thus, the air may flow to the return chamber of the first floor from the working room 11 at its portion requested to have a high cleanliness.

Further, the whole of the ceiling of the working room 11 is formed as a system ceiling of a frame structure. So far the dust-collecting filter is fixedly provided only on a portion of the ceiling of the working room so far. Thus, if the dust-collecting filter were provided on other portion, the dust-collecting filter could not be provided on other portion without the frame on which the dust-collecting filter is disposed. On the other hand, according to this embodiment, in the case of a construction for increasing a class of a cleanliness, the whole of the ceiling is remodeled into a system ceiling, whereby a dust-collecting filter in which the unit size is 600×1200 mm, for example, may be made freely detachable according to the need. On the portion which does not require the dust-collecting filter, there may be attached an air-insulation panel of the same size as an air-insulation member.

Although the whole of the ceiling is formed as the system ceiling as described above, the dust-collecting filter of the same performance need not be attached to the whole of the system ceiling. In particular, this embodiment assumes that the existing air conditioner of the first floor portion is used as it is. If the dust-collecting filter is changed from the HEPA filter to the ULPA filter, then a blow capacity of air conditioner required per same area increases. Accordingly, if the whole of the ceiling is changed from the HEPA filter to the ULPA filter, there is then the risk that the capacity of the conventional air conditioner will become insufficient. If a necessary amount of air cannot be maintained, then a necessary cleanliness also will not be maintained.

Therefore, according to this embodiment, within a range of the amount of air covered by the existing air conditioner, the ULPA filter is provided partly within the specified area of the ceiling. To this end, as the layout of the working room, according to this embodiment, as shown in FIG. 7, treatment equipment 50 are located on both sides of one line (shown hatched), the treatment equipment 50 on the adjacent lines are installed back to back with each other, and the front portion of each treatment equipment is faced to a wafer treatment area in which wafers are moved. Then, in order to enable the-cleanliness of this wafer treatment area to obtain a high cleanliness of about class 1, the ULPA filters are disposed on the ceilings of the wafer treatment area, a wafer stocker area and an area for transporting wafers which are not protected with dust-proof cases. Then, the HEPA filter or the air-insulation panel are disposed on the ceiling of the area of the rear portion of each treatment equipment and the ceiling of other maintenance area, if necessary. If the treatment equipment is disposed within the clean room as described above, then the areas which are requested to become high in cleanliness may be collected efficiently so that the highly-efficient dust-collecting filters such as ULPA filters may be centralized in that area. As a result, it becomes possible to realize the useful layout of the dust-collecting filters, the supply amount of the air-conditioned air in the whole of the clean room can be suppressed to be small, and the air conditioner may be operated with a satisfactory operation efficiency. Further, if the treatment equipment 50 is partitioned by a partitioning member 52 such as an electrostatic shielding transparent acrylic plate, then the portions shown hatched in FIG. 7 become working rooms having a high cleanliness.

In particular, most of the recent wafer treatment equipment have a function to maintain a high cleanliness.

Accordingly, if such wafer treatment equipment is installed, then it is possible to suppress an area of the area which is requested to have a high cleanliness in the clean room to be smaller. The dust-collecting filter becomes much more expensive as its performance increases. Accordingly, if the filter of high efficiency is disposed on all of the ceilings in accordance with an area whose cleanliness is requested to be highest, then the cost thereof increases. On the other hand, if a filter of efficiency corresponding to a necessity is properly disposed in each portion, then it is possible to reduce the cost while maintaining a necessary cleanliness.

As described above, if the whole of the ceiling is formed as the system ceiling and the highly-efficient ULPA filter is disposed only in the area which requires especially high cleanliness, then the cleanliness of the necessary portion may be raised more than ever while most of the existing facilities is used effectively and the ability of the air conditioner does not become insufficient. If the cleanliness of the area in which equipment for effecting a variety of treatments on wafers are disposed is set to be class 1 or higher, then in the case of DRAM (dynamic random-access memory), it becomes possible to manufacture integrated circuits of integration degree of 16 megabits or larger. Also, if the above-described system ceiling is used, then when the layout/arrangement of the line is varied, it becomes possible to realize the optimum filter layout pattern in accordance with a cleanliness required by a semiconductor fabrication line. Further, if the whole of the ceiling is formed as the system ceiling, then it becomes possible to partly remodel the existing clean room in which the air conditioner is installed on the assumption that the HEPA filter is disposed on the whole of the ceiling in accordance with the integration degree of semiconductors. Specifically, utilizing most of facilities such as existing air conditioners, it becomes possible to remodel the existing clean room into a semiconductor fabrication clean room in which a high cleanliness is requested while the cost thereof is suppressed.

A method in which the area B (e.g. cleanliness class is 10000) whose cleanliness is lower than that of the area A is remodeled into a clean room having the same cleanliness as that of the area A as the area A is remodeled in FIGS. 1 and 2 will be described next. Since the area B is so far isolated from the area A by the wall 10, a construction for removing this wall 10 becomes necessary. Moreover, the area B has not been requested to have such a high cleanliness. Since this is the first time that the area B is requested to have a high cleanliness (e.g. about cleanliness class 1), new air conditioners and other facilities should be installed in the area B, and hence a construction therefor becomes necessary.

To this end, initially, as shown in FIG. 4, a false partition panel 40 is installed on the side of the area A adjacent to the wall 10 of both of the first and second floors. As a means of this false partition panel, there may be used a partition panel of the same material as the wall material used in the conventional clean room, e.g. steel partition panel coated with a dust-proof paint in order to avoid the occurrence of static electricity and which can be detached with ease. The false partition panel 40 is requested to have an airtight degree to the extent that dusts occurred when the wall 10 is demolished can be prevented from entering the area A and also requested that it can be detached with ease. A timing at which the false partition panel 40 is installed is such one that a cleanliness of about cleanliness class 1 is expected to be obtained after a period during which the working room is driven in order to increase a cleanliness since the working room on the area A side was expanded and the construction for increasing the cleanliness was ended. Therefore, until that period, the area B may be used as it is.

After the false partition panel 40 is installed, the air conditioner for the area B is stopped, and the wall 10 that has completely partitioned the area A and the area B is demolished. Although dusts are generated during this construction for demolishing the wall 10, the false partition panel 40 may protect the clean room on the area A side from the dusts.

A true partition panel 41 is installed on the place where the demolished wall 10 was built. As the true partition panel 10, there may be used a partition panel of the same material as the false partition panel 40, e.g. steel partition panel coated with a dust-proof paint in order to avoid the occurrence of static electricity and which can be detached with ease. Concurrently with this work, the existing air conditioner of the area B is replaced with the same air conditioner of the area A, the ceiling of the area B is reformed into the system ceiling on which the dust-collecting filer of necessary efficiency is disposed in response to the area. Also, there is carried out a predetermined construction such as to form the floor of the area B as the free access floor. At the stage in which this construction is ended, the new air conditioner for the area B is driven in order to increase a cleanliness. In general, it takes about one month to achieve a necessary cleanliness since the driving for cleanliness is started. When a necessary cleanliness (e.g. about cleanliness class 1) is achieved in this manner, the true partition panel 41 which isolated the areas A and B may be removed. Incidentally, according to the necessity, more lines $\mathbf{20}_6$, $\mathbf{20}_7$ and stations $\mathbf{22}_6$, $\mathbf{22}_7$ may be built and the interbay transport machine 21 may be extended in accordance therewith.

Incidentally, since this true partition panel 41 is made of the material for the clean room and may be easily removed, if this true partition panel 41 need not be removed immediately, this true partition panel 41 may be removed later at any time according to the necessity. Under the condition that the true partition panel 41 remains as it is, the clean room may be used independently as the areas A and B as before. In this case, it is considered that the false partition panel 40 is left instead of the true partition panel 41. However, if so, the position of the partition panel is displaced from the position of the original wall 10 to the side of the area A with the result that the false partition panel 40 exists in somewhere of the air conditioner in the area A adjacent to the wall 10. In that case, if the cleanliness of the areas A and B is different, it is not desirable that the air conditioner adsorbs the air from the region in which the cleanliness is low. Accordingly, when the area A and the area B are independently used, the false partition panel 40 is removed finally and the true partition panel should preferably be left.

The case in which the areas A and B are remodeled at substantially the same period has been described so far. This method may apply for the case in which a general room isolated from the adjacent existing room by a wall is remodeled into a new clean room and a wide clean room is obtained by removing the wall between it and the adjacent clean room as well. Also, while continuing the driving of the original clean room, the adjacent general room may be remodeled into a clean room. Also in this case, while a false partition panel is left between adjacent clean rooms, such clean rooms may be used as independent clean rooms, respectively.

As described above, when the wall 10 between the areas A and B is demolished, the false partition panel is disposed near the wall 10. This method using the false partition panel is not limited to the case in which two areas are jointed by demolishing the wall but may be apply for the case in which a high cleanliness is realized by remodeling the area A as well. Specifically, when a remodeling construction for increasing the cleanliness of the area A is made, instead of stopping the operation of the whole of the area A so that the whole of the area A is constructed at the same time, the area A is divided into a plurality of small rooms by using the false partition panels, each small room is sequentially constructed in a necessary manner, a working for increasing a cleanliness is sequentially started from the small room whose construction is ended, and finally, a predetermined cleanliness is achieved with respect to the whole of the area A. If this method is used, then a period required to start the driving of the clean room may be reduced so that a period in which a predetermined cleanliness is achieved may be reduced. Then, an operation of line may be started from the small room with the predetermined cleanliness being achieved.

In this case, a minimum division in which the false partition panel is installed is made corresponding to a minimum unit of air conditioner. In FIG. 1, for example, there are provided the three air conditioners $\mathbf{14}_1$, $\mathbf{14}_2$, $\mathbf{14}_3$ for the area A. Accordingly, in this case, the area A is divided into three small rooms similarly to the number of the air conditioners by using two false partition panels relative to the area A. Then, the remodeling construction and the work for increasing the cleanliness are started from the small room adjacent to the area B in FIG. 1, and the operation of the line is started from the small room in which the predetermined cleanliness was achieved. When the cleanliness of the adjacent small rooms becomes the same, the false partition panel between such adjacent small rooms may be removed.

Figure 8:
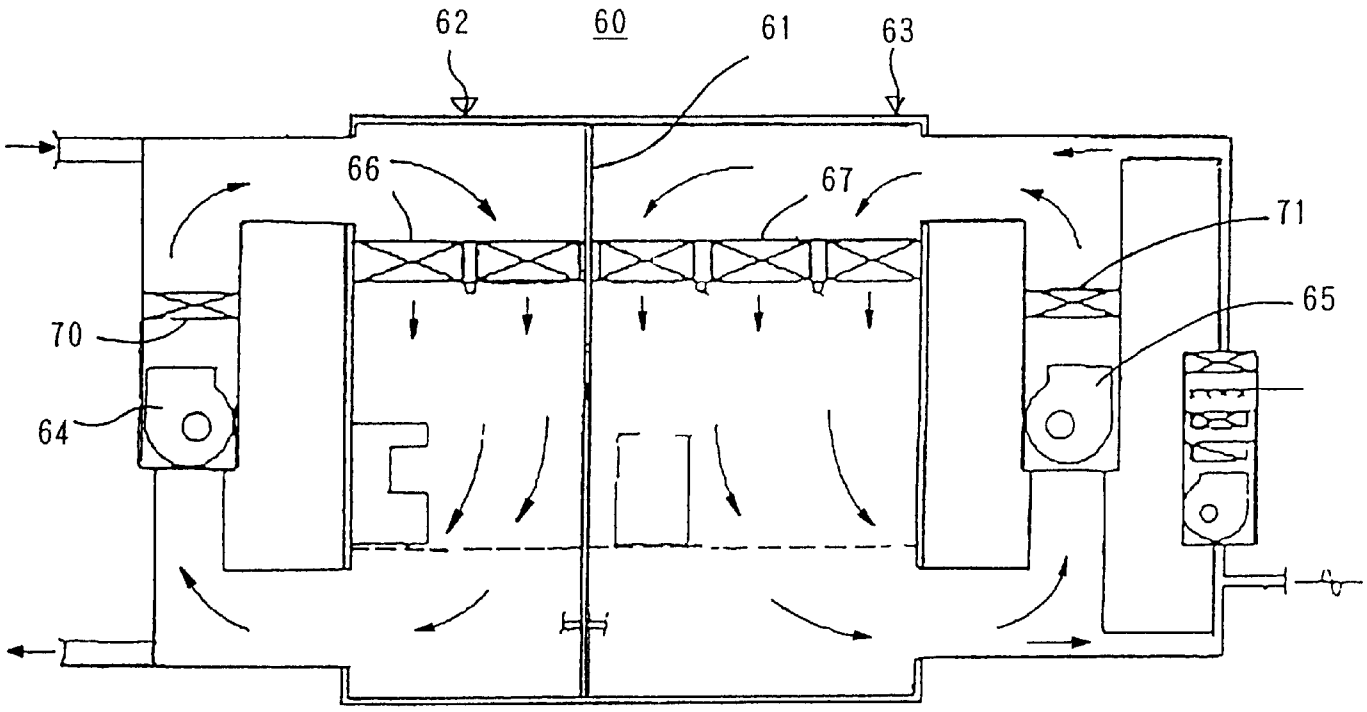
FIG. 8 is a cross-sectional view used to explain the manner in which one clean room comprising two (or more than two) areas divided by a wall is remodeled at every area.

As shown in FIG. 8, for example, let it be assumed that one existing clean room 60 is divided by a wall 61 into two (or more than two) areas 62, 63 and that air conditioners 64, 65 are disposed in the areas 62, 63, respectively. Such example is the case that the clean room should be divided into working rooms such as when the area 62, for example, is used as a working room in which acid-based substance is used and the area 63 is used as a working room in which an alkaline-based substance is used. Dust-collecting filters 66, 67 are disposed on the ceilings of the respective areas 62, 63, and the floor of each of the areas 62, 63 is formed as the free access floor of the grated panel structure. Incidentally, pre-filters 70, 71 are disposed on the upper portions of the air conditioners 64, 65.

When the cleanliness of the whole of the clean room 60 is increased, since the clean room 60 is divided by the wall 61 into the two regions 62, 63, during a period in which one area is being remodeled, the other area is continuously driven as it is. At the stage the remodeling construction of one area is ended and a predetermined cleanliness is achieved, the remodeling construction of the other area may be started. According to this method, the remodeling construction can be advanced efficiently so that during a period in which one area cannot be driven because of the remodeling construction, the other area can be driven. Thus, a decrease of a throughput of the whole of the factory may be held small. Also, although the whole of the areas cannot be actuated at the same time, it becomes possible to actuate only a part of the area.

Incidentally, the present invention is not limited to the above-described embodiment, and may be variously modified without departing from the scope of the invention. For example, while the cleanliness is improved and the clean room is expanded up to the adjacent general room when there is a clean room as described above, the present invention is not limited thereto, and may apply for the case in which a general building, which is not the clean room, is remodeled into a clean room by the above similar construction as well.

As set forth above, according to the present invention, it is possible to provide a clean room remodeling method in which when the existing clean room is remodeled into the clean room having a higher cleanliness, the existing air conditioner may be used as it is, a new air conditioner need not be installed by the remodeling construction, a clean room having a higher cleanliness may be obtained while the existing facilities are utilized effectively and in which the operation of the clean room can be started earlier. Further, it is possible to provide a clean room remodeling method in which an operation of a clean room can be started earlier when a single clean room is formed by removing a wall between two adjacent clean rooms and when a clean room is expanded up to the adjacent general room.

Having described a preferred embodiment of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A clean room remodeling method for remodeling a clean room comprising an air conditioner and a return chamber located on a first floor, a semiconductor fabrication working room located on a second floor above said first floor and a supply chamber located in a space above the ceiling of said working room to supply the air to said working room, comprising the steps of:

forming a floor of said working room as a grated panel structure;

forming a ceiling of said working room as a system ceiling;

disposing a first dust-collecting filter in a ceiling of said working room at its area in which a high cleanliness is required partly;

disposing a second dust-collecting filter or an air-shielding member in ceilings of other areas; and using said air conditioner as it is.

2. A clean room remodeling method as claimed in claim 1, wherein said first dust-collecting filter is a ULPA filter and said second dust-collecting filter is a HEPA filter.

3. In a clean room remodeling method in which a clean room is expanded by removing a wall which partitions a clean room and a room adjacent to said clean room, said clean room remodeling method comprising:

a process for setting a detachable first partition panel near said wall within said clean room;

a process for removing said wall;

a process for setting a detachable second partition panel at a place from which said wall was removed;

a process for removing said first partition panel;

a process for cleaning air in said room; and a process for joining said clean room and said room by removing said second partition panel after the process of cleaning of the air in said room is completed.

4. A clean room remodeling method as claimed in claim 3, wherein said room is a clean room.

5. A clean room remodeling method comprising:

a process for expanding a clean room area by removing a whole-process direction wall between an existing clean room and a general room;

a process for installing an interbay transportation apparatus in an upper portion of an area which was said general room;

a process for extending a process line provided in the direction substantially perpendicular to said whole-process direction; and a process for partitioning an area which was a clean room and an area in which said interbay transportation apparatus is installed.

6. A clean room remodeling method comprising:

a process for dividing an existing clean room having a plurality of air conditioners into a plurality of areas at the unit of said air conditioner by a partition panel;

a process for constructing each of divided areas sequentially in order to increase a cleanliness;

a process for cleaning the air of every said area whose construction is ended; and a process for removing a partition panel when the adjacent area reaches the same predetermined cleanliness.

7. A method of remodeling a general room into a clean room with respect to an existing building having a first floor, a second floor, and a space above a ceiling of the second floor, comprising the steps of:

providing an air conditioner and a return chamber on said first floor;

forming a floor of said second floor as a grated panel structure;

disposing a dust-collecting filter in the ceiling of said second floor;

providing a supply chamber in a space above the ceiling of said second floor;

joining said return chamber and said supply chamber by a duct; and forming said second floor as a semiconductor.

* * * * *